US005591031A

United States Patent [19]

Monk et al.

[11] Patent Number: 5,591,031

[45] Date of Patent: Jan. 7, 1997

[54] MISSILE SIMULATOR APPARATUS

[75] Inventors: Ronald W. Monk; David P. VanCleve; Robert J. Curry, all of Tucson, Ariz.

[73] Assignee: Hughes Electronics, Los Angeles, Calif.

[21] Appl. No.: 251,067

[22] Filed: May 31, 1994

[51] Int. Cl.[6] ..... G09B 19/00

[52] U.S. Cl. ..... 434/14; 434/11; 324/73.1; 89/41.01

[58] Field of Search ..... 434/11, 14, 15, 434/21–23, 25, 27, 379; 273/313, 316, 317; 364/423, 578; 89/41.01; 455/39, 73; 324/73.1, 158.1

[56] References Cited

U.S. PATENT DOCUMENTS

| | | | |
|---|---|---|---|
| 2,938,201 | 5/1960 | Thornton | 434/12 |
| 2,971,274 | 2/1961 | Thornton | 434/12 |
| 3,343,486 | 9/1967 | Patrick . | |
| 3,976,009 | 8/1976 | Delgado et al. . | |
| 4,620,484 | 11/1986 | Livne . | |
| 4,825,151 | 4/1989 | Aspelin | 324/73.1 |
| 5,228,854 | 7/1993 | Eldridge | 434/27 X |
| 5,414,347 | 5/1995 | Monk et al. | 324/73.1 |

FOREIGN PATENT DOCUMENTS

| | | |
|---|---|---|
| 0387438 | 9/1990 | European Pat. Off. . |
| 0579143 | 1/1994 | European Pat. Off. . |
| 2202061 | 9/1988 | United Kingdom . |

*Primary Examiner*—Joe Cheng

*Attorney, Agent, or Firm*—Charles D. Brown; Wanda K. Denson-Low

[57] ABSTRACT

A missile simulator training apparatus (44) for pilot training of an aircraft of the type having at least one missile station, including a pre-launch module (10) for substantially simulating the pre-launch functions of a missile in response to data received from the aircraft. The apparatus also includes an inert factor formed missile body (32), thereby providing the apparatus with static and aerodynamic loads equivalent to that of an actual missile. The apparatus further includes a data link and data capture module (46) for recording all data transactions between the apparatus and the aircraft for post-flight analysis of aircraft and pilot performance.

16 Claims, 7 Drawing Sheets

15
A
B
MASTER ARM
+15V
MISSILE ADDRESS
J
40
+5V
RELEASE CONSENT
38
+5V
400Hz IN
400Hz RTN
INTERLOCK RTN
STORE GONE
INTERLOCK
K2 RELAY
+5V
IFLO
+5V
K1 RELAY

MISSILE SIMULATOR APPARATUS

BACKGROUND OF THE INVENTION

1. Technical Field

The present invention relates generally to aircraft missile systems, and more particularly to a missile simulator apparatus for simulating the pre-launch functions of a missile and recording the data communications between the apparatus and the fire control system of the launching aircraft.

2. Discussion

Military aircraft are typically designed to be equipped with a plurality of deployable missiles, such as advanced, medium range air-to-air missiles (hereinafter referred to as AMRAAMs). A missile and its corresponding missile launcher, which may be either a rail launcher or an eject launcher, combine to form a missile station. Within such military aircraft resides a fire control system which is responsive to pilot initiated commands. The fire control system functions to communicate with each missile station to monitor status, perform launch preparation, and execute launch commands. A missile interface translates the commands from the fire control system to provide data used to monitor and/or control the missile stations.

A typical on-board missile interface includes an umbilical interface and a data link interface. The umbilical interface serves as a communication channel between the fire control system and the missiles prior to the opening of missile interlock and launch separation, while the data link interface provides a communication channel to the opening of missile interlock and the missiles subsequent to launch separation.

Frequently, it is desirable to simulate conventional pre-launch functions of a missile, such as weapons identification, "all-good" built-in-test (hereinafter BIT), and launch cycle responses (including the opening of missile interlock), without involving a functional missile. Such situations include training exercises in the areas of pilot flight training, ground test training, and load crew training, as well as missile interface testing.

Various systems have been previously employed to simulate the pre-launch functions of a missile in a training and testing application. One such device, commonly referred to as an Integration Test Vehicle (ITV), is a specially modified AMRAAM missile. The ITV is an all-up-around missile that is fitted with an inert rocket motor and a telemetry unit in place of a warhead. Other known missile simulation systems incorporate unique simulation-made software specifically designed to function with a particular type of missile and the fire control system of a particular type of aircraft.

For the majority of missiles other than AMRAAMs (e.g., Sidewinder), a simple plug can be used to route analog aircraft signals to simulate a functioning missile to the aircraft fire control system. However, such a plug cannot be used with AMRAAM adapted missile stations since the interface to the AMRAAM includes a more complex combination of discrete signals and MIL-STD-1553 serial data with specific timing requirements imposed.

While prior systems have proven moderately successful, they are not without their inherent drawbacks. For example, systems such as the one discussed above including a modified AMRAAM missile generally require a complex and costly ground telemetry station for real time capture and post-analysis of pre-launch and post-launch data. Further, systems including uniquely developed software are cost prohibitive and are not readily compatible with most aircraft. Still yet, most prior systems are extremely complicated.

SUMMARY OF THE INVENTION

The present invention overcomes the above-discussed and other drawbacks of the prior art by providing three distinct embodiments.

In a first embodiment thereof, the present invention is operative for pilot training by substantially simulating the pre-launch functions of a missile. More particularly, the first embodiment of the present invention provides a missile simulator module or pre-launch module for simulating typical missile pre-launch functions such as weapons identification, "all-good" built-in-test (BIT), and launch cycle responses, including the opening of missile interlock. The first embodiment of the present invention is further adapted for communication with the aircraft fire control system.

The pre-launch module comprises a dual redundant Military Standard 1553 interface chip set, a microprocessor with memory, a discrete signal conditioning module, power detection circuitry and power conversion circuitry.

In a second embodiment thereof, the present invention provides a missile simulation device operative for training of pilots, as well as training of ground test crews and load crews. The missile simulation device includes an inert form factored missile body of substantially the same weight, size and shape of the actual missile, to be simulated. The inert form factored missile body is designed to house the pre-launch module of the first embodiment of the present invention. Thus, with the pre-launch module, the missile simulation device is operative to be used to simulate typical missile functions such as weapons identification, "all-good" BIT, and launch cycle responses, including the opening of missile interlock. Additionally, the missile simulation device is designed to present an aircraft with static and aerodynamic loads substantially equivalent to that of an equivalent live missile.

In a third embodiment, the missile simulation device of the second embodiment of the present invention is further operative to record all data transactions with the aircraft for post flight analysis of aircraft and pilot performance. In this regard, the third embodiment further includes a data link and data capture module and a RF detector. The data link module includes a microprocessor and operates to allow the aircraft to data link to the pre-launch module. During a post-flight data analysis, the memory of the data link and data capture module can be accessed via an umbilical cable which can be attached to the missile apparatus and analyzed by a personal computer.

BRIEF DESCRIPTION OF THE DRAWINGS

Various advantages of the present invention will become apparent to one skilled in the art upon reading the following specification and by reference to the following drawings, in which.

DETAILED DESCRIPTION OF THE PREFERRED EMBODIMENT

While the present invention is illustrated throughout the Figures with reference to particular embodiments, it will be appreciated by those skilled in the art that the particular embodiments shown are offered as examples which incorporate the teachings of the present invention and are merely exemplary.

Figure 1:
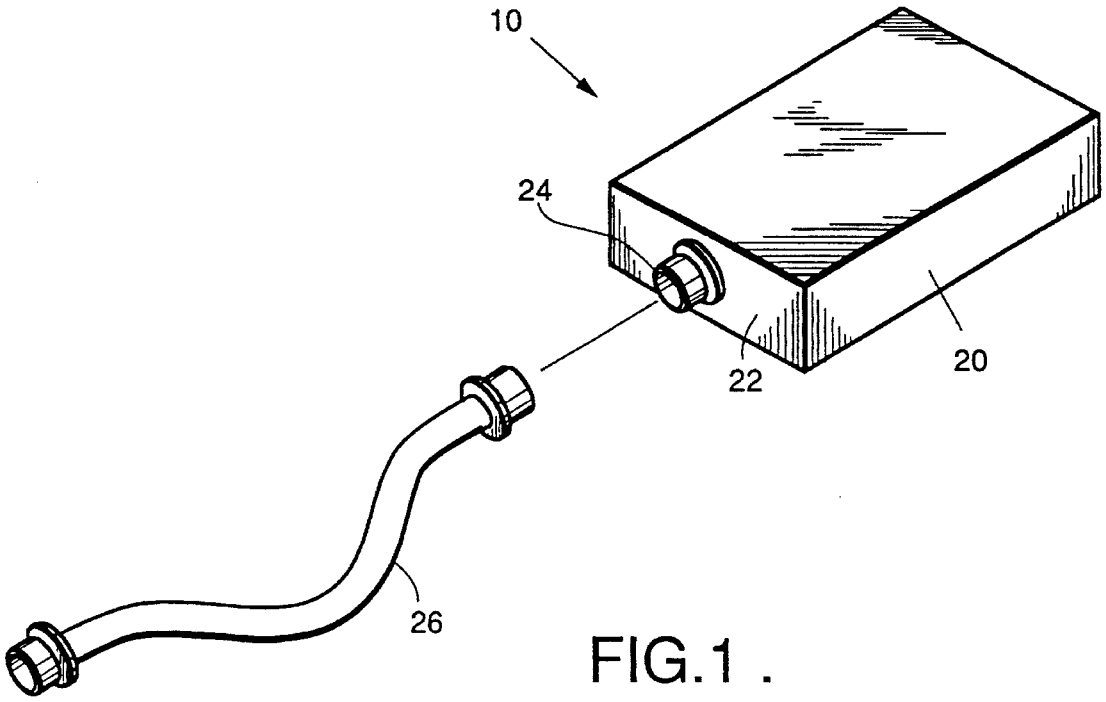
FIG. 1 is a partially exploded perspective view of a pre-launch module constructed in accordance with a first embodiment of the present invention.

Turning to FIG. 1, illustrated is the missile simulator apparatus or pre-launch module 10 which is constructed in accordance with a first embodiment of the present invention. The pre-launch module 10 is particularly adapted for operational pilot training of an aircraft (not shown) of the type having at least one missile station. In this regard, the pre-launch module 10 is operative for substantially simulating the pre-launch functions of a missile in response to pilot driven signals received from the aircraft fire control system. The pre-launch module 10 also operates to communicate the simulated functions to the aircraft.

Figure 6:
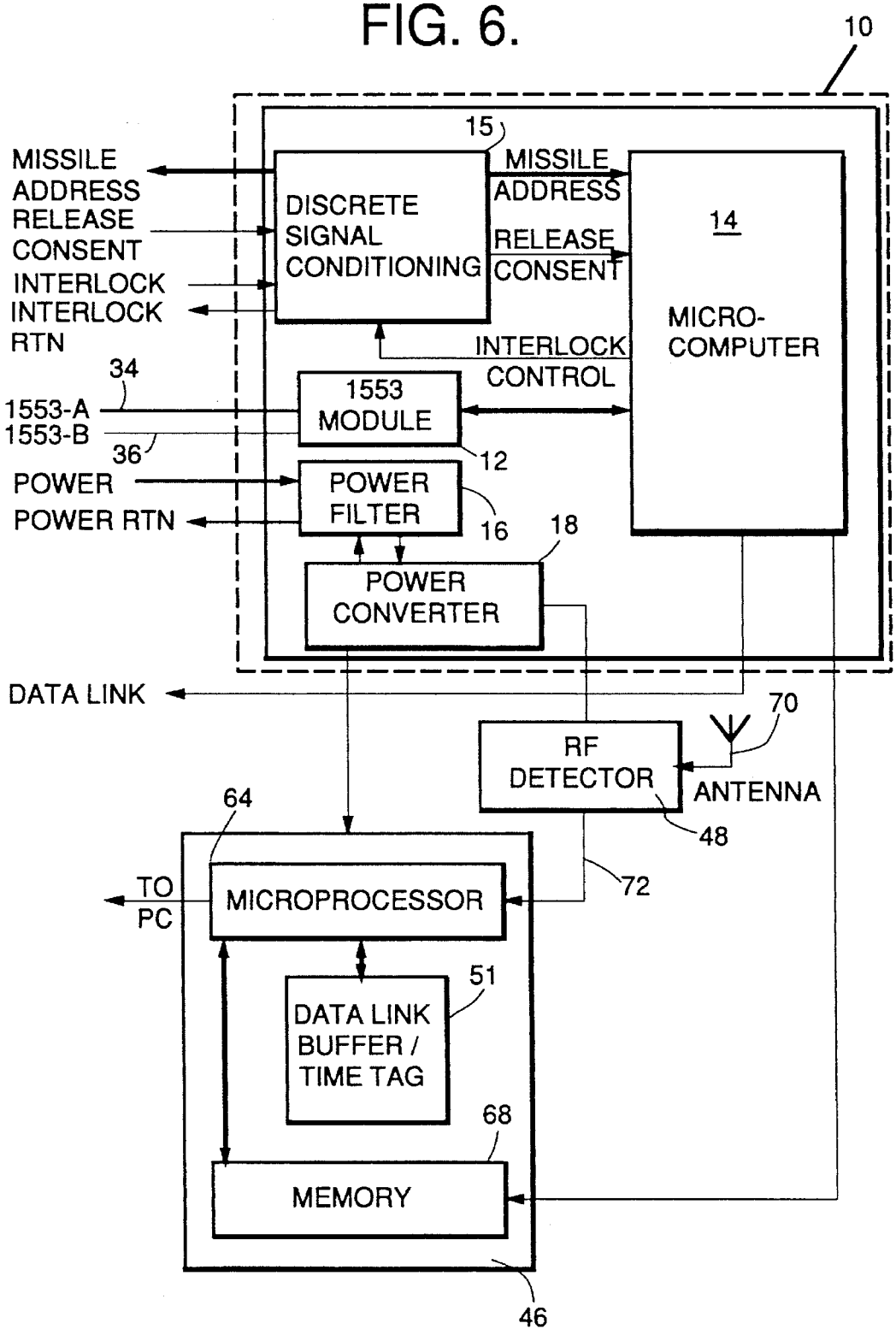
FIG. 6 is a block diagram of the missile simulation device of FIG. 5.

As shown in FIG. 6, the pre-launch module 10 of the present invention consists of a MIL-STD-1553B circuitry 12, a microcomputer 14 with memory, discrete signal conditioning circuitry 15, a power filter 16, and power conversion circuitry 18. The entire pre-launch module 10 is powered from +28 VDC supplied by the aircraft.

Figure 2:
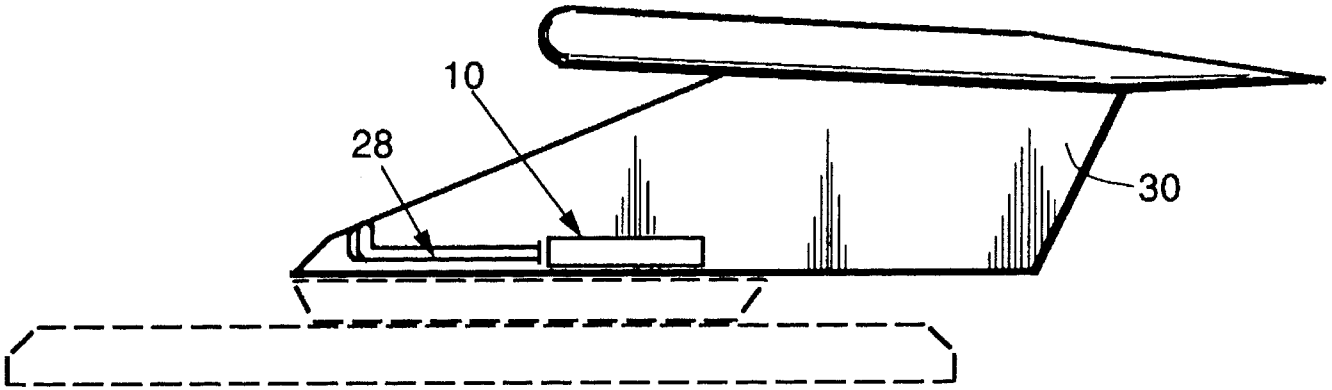
FIG. 2 is a diagrammatical representation of the pre-launch module of FIG. 1, as shown operatively connected to a missile station of an aircraft.
Figure 4:
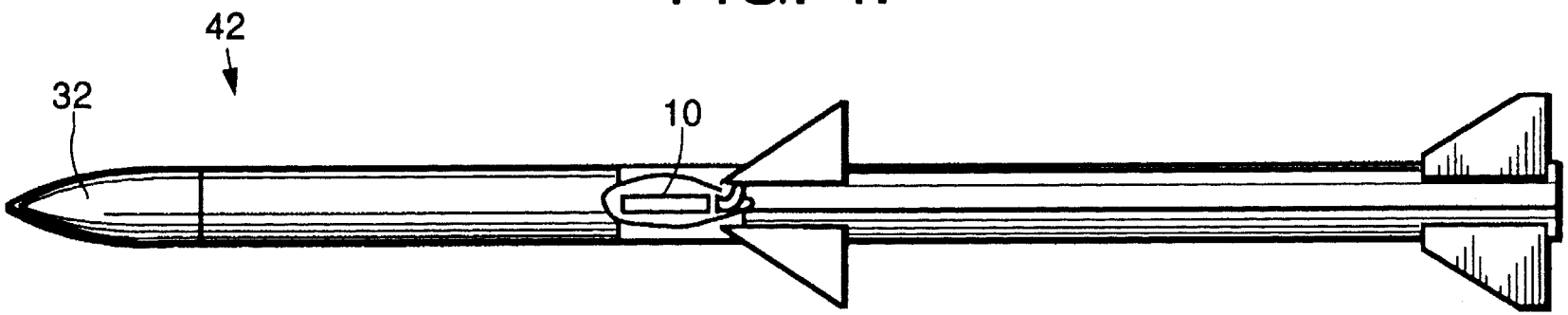
FIG. 4 is a partially cutaway side view of a missile simulation device constructed in accordance with a second embodiment of the present invention.

The pre-launch module 10 is packaged appropriately for the flight environment. In this regard, the components of the pre-launch module 10 are commonly located in a single housing 20 (see FIG. 1). The housing 20 is approximately 2"×4"×10". At one end 22, the housing 20 includes a port 24 adapted to receive an umbilical cable 26. The pre-launch module 10 is adapted to connect to existing cabling 28 when mounted in a pylon 30 or faring (as shown in FIG. 2) or, as will be described in greater detail below, to a missile umbilical connector (not shown) when mounted in an inert form factored missile body 32, such as illustrated in FIG. 4.

The interface to an AMRAAM is a complex combination of discrete signals and MIL-STD-1553B serial data with specific timing requirements imposed. As a result, a simple plug which can be used to reroute analog aircraft signals to simulate a functioning missile to the aircraft fire control system for other missiles, such as a Sidewinder missile, cannot be incorporated with an AMRAAM interface.

With continued reference to FIG. 6, it will be understood that in the present invention means for transmitting and receiving data is provided by the MIL-STD-1553B circuitry 12. The 1553 circuitry 12 is a commercially available dual redundant Military Standard (MIL-STD) 1553 interface chip set which is adapted to transmit and receive all 1553 traffic to and from the aircraft. The chip set includes an encoder/decoder, transceivers, and transformers for coupling to the aircraft bus (not shown). A and B channels 34,36 are incorporated into the 1553 circuitry 12. The 1553 circuitry 12 is adapted to generate standard responses to wake-up messages and status requests received from the aircraft fire control system.

Figure 3A:
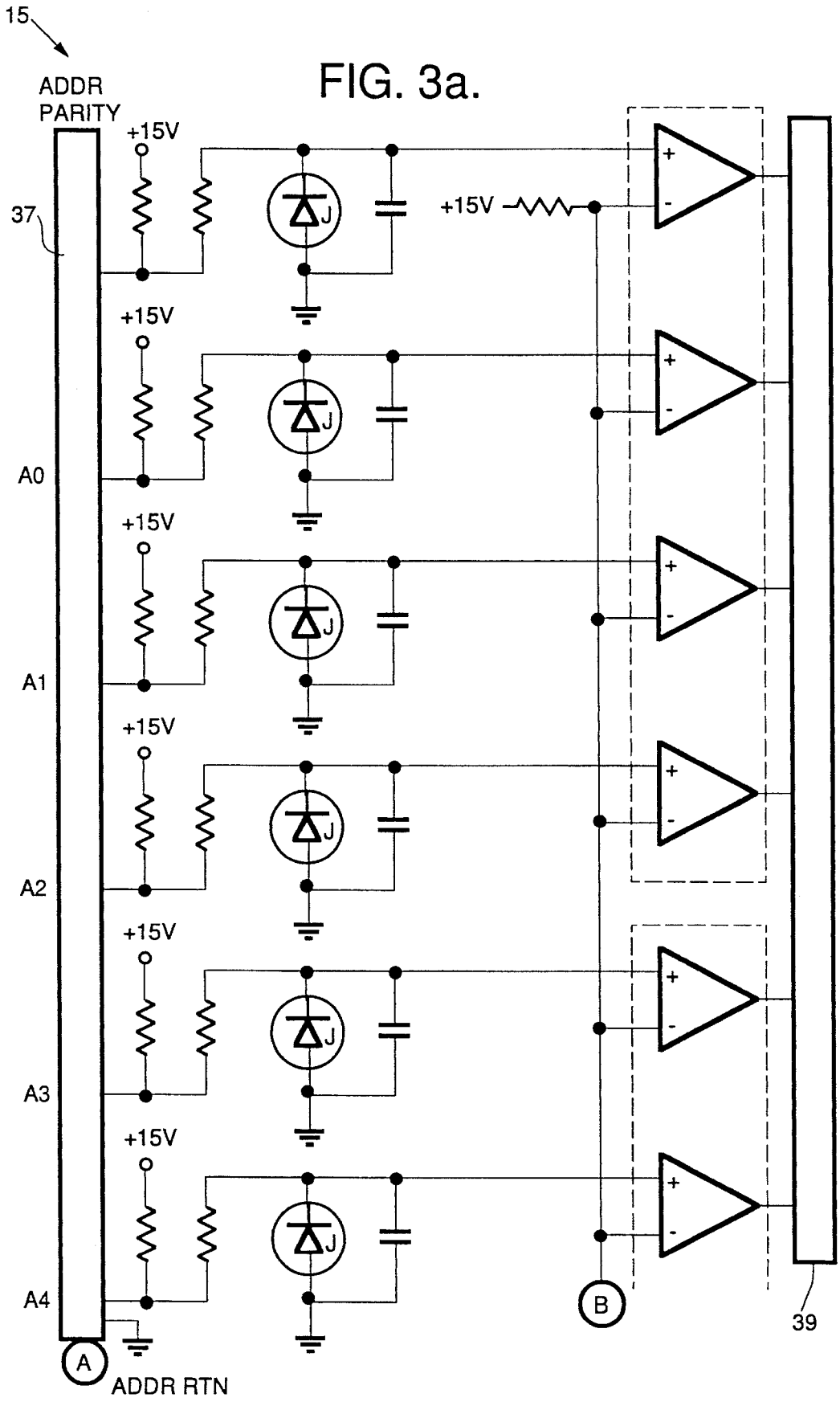
FIGS. 3A and 3B are schematic diagrams of the discrete signal conditioning circuitry portion of the pre-launch module.
Figure 3B:
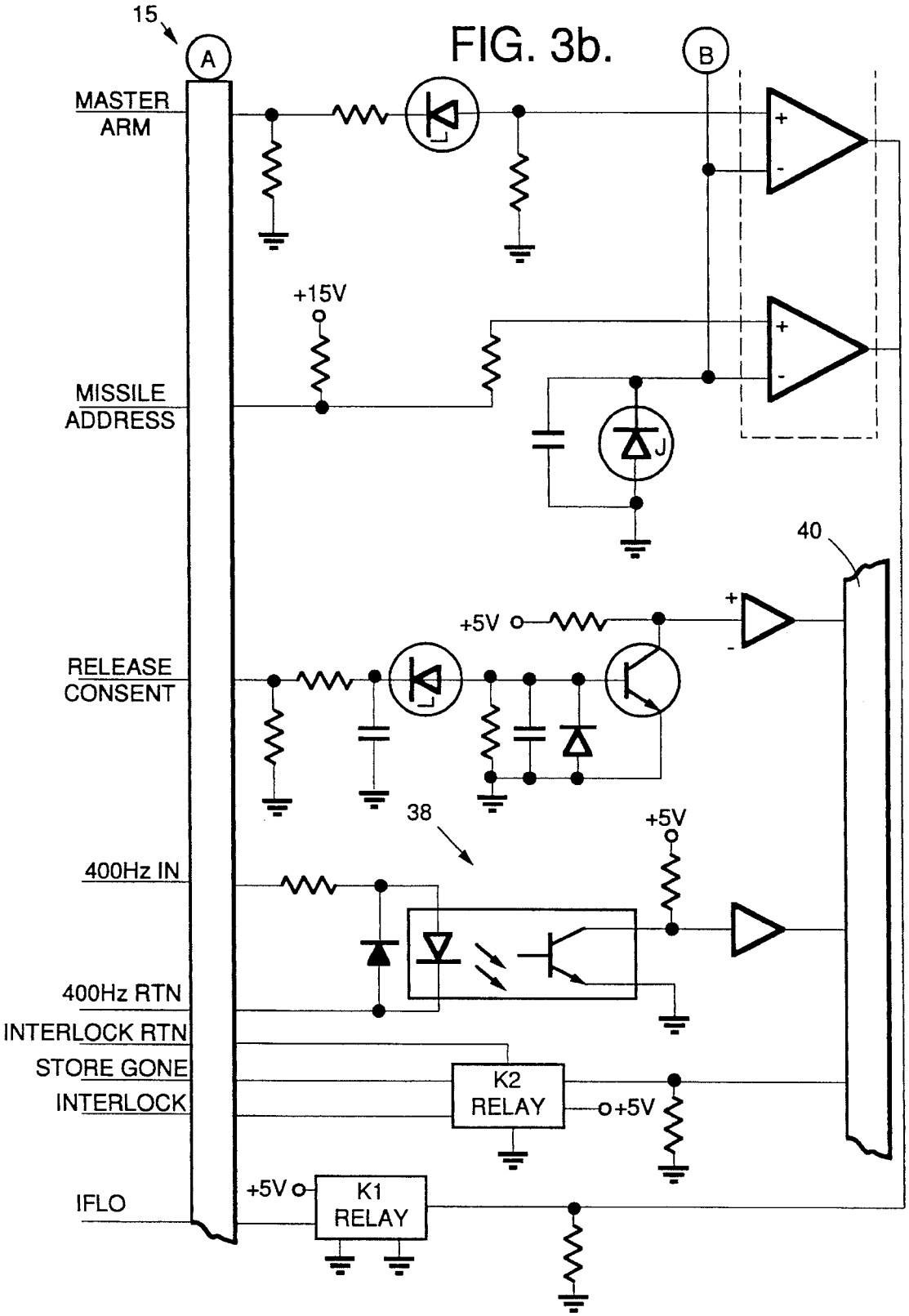

Means for converting static signals to TTL level signals is provided by the discrete signal conditioning circuitry 15. The discrete signal conditioning circuitry 15 of the present invention, which is schematically diagrammed in FIGS. 3A and 3B, functions to receive, filter and convert to a TTL level the signals received from the aircraft missile stations and feed the conditioned signals into the microcomputer 14. These conditioned signals include missile address, release consent, and master arm (as shown in FIG. 3B). The discrete signal conditioning circuitry 15 includes a connector 37 for receiving inputted electronic data. Outputted TTL level signals are delivered either to the microcomputer 14 or a connector 39 (as shown in FIG. 3A) located on the 1553 circuitry 12.

Missile address informs the missile as to its 1553 communication location. In FIG. 3A, five independent communication locations are represented by A0, A1, A2, A3 and A4. It will be appreciated by those skilled in the art that additional communication locations can be similarly incorporated.

Release consent is a +28 volt signal which is generated by an aircraft in conjunction with the application of 400 Hz, 3-phase power to identify the initiation of a launch cycle. The presence of release consent after application of the 400 Hz, 3-phase power source to the missile indicates that a launch cycle is to be performed. If release consent is absent upon application of the 400 Hz, 3-phase power source, then the missile executes a built-in-test (BIT) sequence only.

Master arm is a signal initiated by the pilot, and is similar to a safety in that it must be activated prior to missile launch. In flight lock (IFOL) is a signal normally produced by a missile station upon activation of master arm. IFOL indicates that the missile station has received the master arm signal.

Interlock and interlock return signals are provided by the missile to the aircraft and are used by the aircraft to sense the presence of the missile. When the missile is physically connected to the launcher of an aircraft, the interlock and interlock return are electrically shorted. When the missile leaves the aircraft, the interlock and interlock return signal paths are broken. Store gone is a signal which indicates departure of a missile.

Interlock control (Interlock CTRL) is used by the pre-launch module 10 of the present invention to activate an interlock relay (not shown) located on the pre-launch module 10 to simulate missile separation during a launch sequence for eject launchers. A preferred construction of an interlock relay shown in conjunction with discrete signal conditioning circuitry is shown and described in U.S. patent application Ser. No. 08/272,441, filed Jul. 8, 1994, now U.S. Pat. No. 5,414,347, which is a continuation of U.S. patent application Ser. No. 07/912,442, filed Jul. 13, 1992, now abandoned, and assigned to the common assignee of the subject invention.

The power converter circuitry 18 (as shown in FIG. 6) converts +28 VDC aircraft power to +5 V, +15 V and −15 V power for use with logic and relay control. A suitable power converter is commercially available from Interpoint Corp., Part No. MTR28515TF/ES.

As illustrated in FIG. 3B, the discrete signal conditioning circuitry 15 further includes 400 Hz power detection circuitry 38. Upon application of 400 Hz power the power detection circuitry 38 delivers a signal to a bus 40 of the microprocessor 14. The pre-launch module 10 is designed to assume a good aircraft, therefore no verification of proper phase rotation or phase presence is required.

The power filter 16 (illustrated in FIG. 6) of the pre-launch module 10 serves to filter and otherwise transiently protect +28 V power which passes between the aircraft and power converter 18. Power delivered to the filter 16 passes through a reverse polarity protection diode (not shown). A suitable filter 16 is commercially available from Interpoint Corp., Part No. FM704A/ES.

The microcomputer circuitry 14 (illustrated in FIG. 6), or microprocessor, consists of a Motorola 68332 microprocessor, 64 kilobytes of RAM and 128 kilobytes EEPROM. The microcomputer circuitry 14 is adapted to control the overall operations of the pre-launch module 10. The microprocessor 14 includes integrated TTL input/output channels that are designed to interface with the discrete signal conditioning circuitry 15. The microprocessor 14 communicates with the 1553 circuitry 12 through a 16 bit bus (not shown).

Turning to FIG. 4, illustrated is a missile simulation device 42 constructed in accordance with a second embodiment of the present invention. The missile simulation device 42 of the second embodiment incorporates the pre-launch module 10 of the first embodiment and is thus similarly operative to substantially simulate the pre-launch functions of a missile, as well as communicate the simulated functions to the aircraft. The missile simulation device 42 further includes an inert form factored missile body 32 which is substantially the same weight, size and shape of an actual missile, such as an AMRAAM missile. The inert form factored missile body 42 serves to present an aircraft with static and aerodynamic loads substantially equivalent to that of equivalent live missiles. The missile body 42 is adapted to be attached to a missile station of an aircraft in a manner substantially identical to that of a conventional live missile. The inert form factored missile body 42 contains no live warhead or rocket motor. The missile simulation device 42 of the second embodiment of the present invention is additionally operative for training of ground test crews and load crews.

Figure 5:
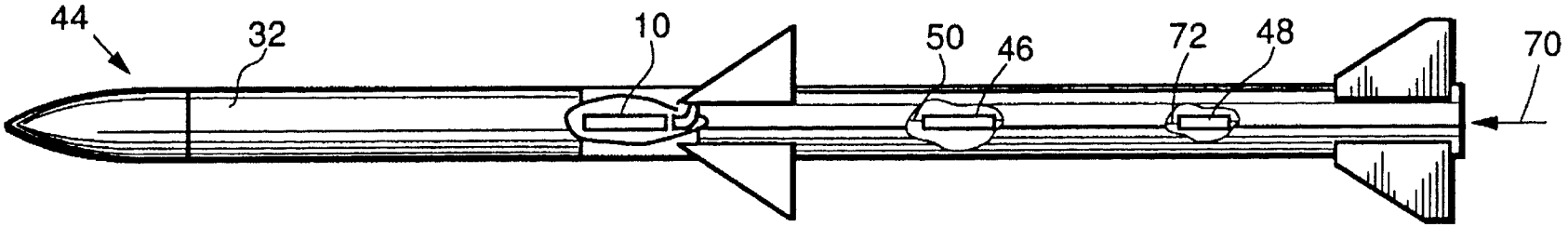
FIG. 5 is a partially cutaway side view of a missile simulation device constructed in accordance with a third embodiment of the present invention.

Turning to FIG. 5, illustrated is a missile simulation device 44 constructed in accordance with a third embodiment of the present invention. As with the missile simulation device 42 of the second embodiment, the missile simulation device 44 of the third embodiment of the present invention is operative for training of pilots, ground test crews and load crews. Additionally, missile simulation device 44 the third embodiment is operative for recording all data transactions with the aircraft for post-flight analysis of aircraft and pilot performance. To this end, the missile simulation device 44 of the third embodiment further comprises a data link and data capture module 46 and a radio frequency (RF) detection module 48.

The data link and data capture module 46 is connected to the pre-launch module 10 via an umbilical cable 50 (as shown in FIG. 5) and serves to decode data link targeting data messages, record the time that particular messages are received, and to record data from the pre-launch module 10. As shown in FIG. 6, the data link and data capture module 46 includes data link buffer/time tag circuitry 51.

Figure 7:
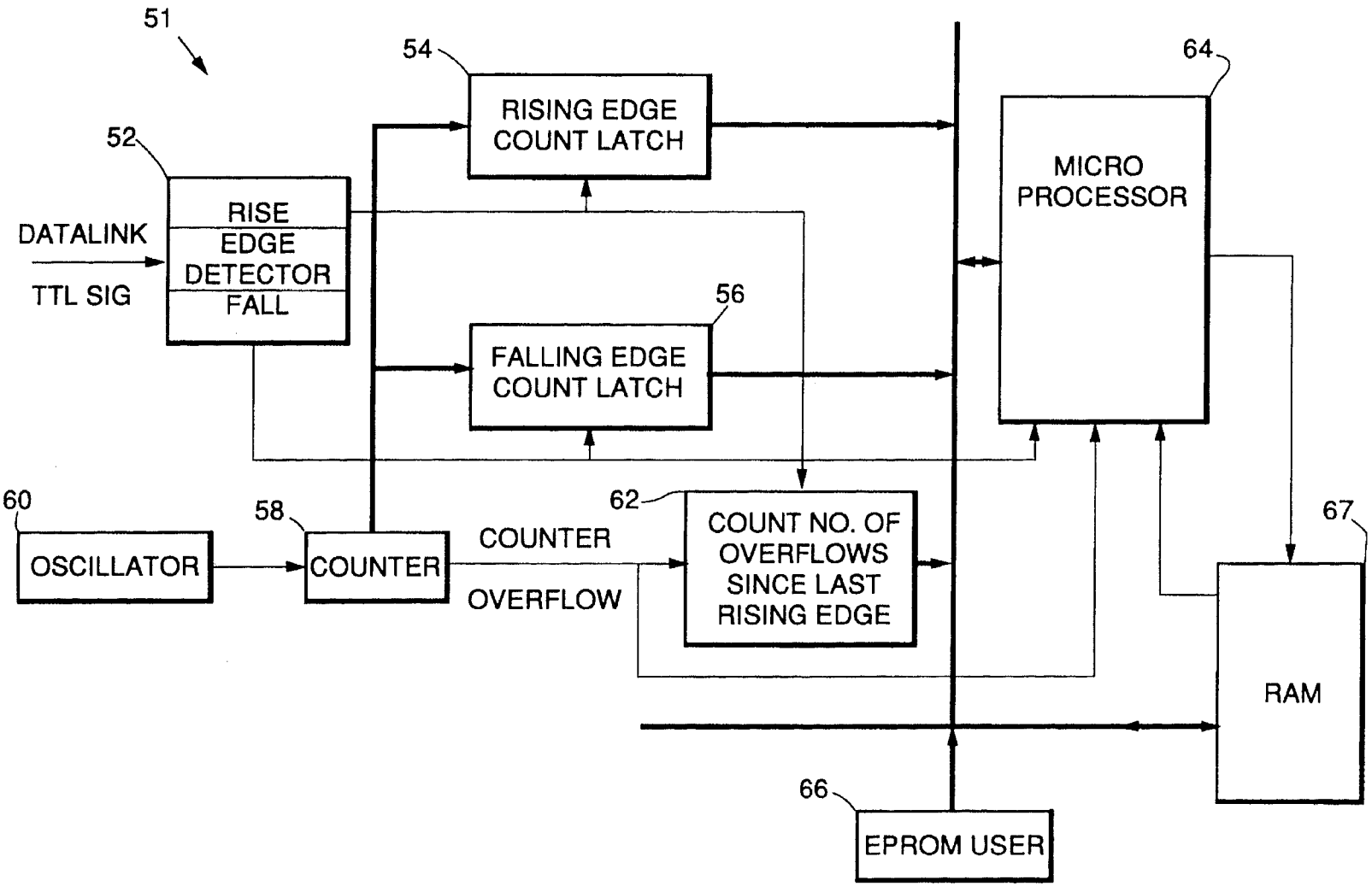
FIG. 7 is a block diagram illustrating the major functions performed by the data link buffer/time tag board of the data link and data capture module of FIG. 6.

Turning to FIG. 7, the major functions performed by the data link buffer/time tag circuitry 51 of the data link and data capture module 46 are shown in block diagram. An edge detector circuitry 52 is provided which is used to identify the rising and falling edge of each data link pulse. The output of the edge detect circuitry 52 is used to latch the time the rising and negative edge occurred in rising edge and falling edge storage registers 54,56 respectively. Time is provided by a 16 bit counter 58 which is clocked by a 20 MHz oscillator 60 resulting in a time resolution of 50 nsec. A second counter 62 counts the number of counter overflows between the rising and falling edge of the data link pulse. This value, along with the count latched in the falling and rising edge count storage registers 54,56 is used by a microprocessor 64 to determine the time the rising and falling edge occurred. The microprocessor 64 is interrupted upon detection of a pulse by the edge detector circuit. When interrupted, the latched times are read by the microprocessor 64. An analysis of the pulse width duration and time from the last pulse is performed by firmware resident in EPROM 66 to validate and decode the incoming data link message.

The decoded message, along with a time stamp of when the message occurred, is then stored in a dual port RAM 67 for later uploading to the data capture circuitry. The data link and data capture module 46 data logs the pre-launch and post-launch data traffic between the aircraft and missile simulation apparatus 44 for post-flight analysis of pilot and launch vehicle performance. During flight, the pilot is able to indicate simulated BIT and launch of the missiles. Once the aircraft is on the ground, the memory of the data link and data capture module 46 is accessible through an umbilical cable (not shown) attached to a personal computer (not shown). This down-loaded data can be used in analysis of pilot and aircraft performance including pre-launch events and data link.

The post-launch data link messages are transmitted from the RF detector 48 to the data link and data capture module 46 via an umbilical cable 72. The post-launch data link messages are received by the RF detector 48 through an antenna means 70, on the missile simulation device 44 in a manner similar to that used with live missiles. The RF detector 48 serves to convert the aircraft's transmitted RF messages into digital logic level, serial data stream that can be processed by the data link circuitry of the data link and data capture module 46. Suitable RF detectors are commercially available.

It should be appreciated by those skilled in the art that the packaging of the components of the present invention is to be understood as merely exemplary. In this regard, the components of the pre-launch module 10 and the data link and data capture module 46 can alternately be commonly located within a single housing.

An aircraft designed to carry missiles typically include a plurality of missile stations. Each missile station includes a launcher umbilical connector. Preferably, for full operational training of the aircraft, a training module 10 is attached in electrical communication with each of the missile stations of the aircraft. By utilizing the training modules 10 incorporated into the missile simulation device 44 of the third embodiment of the present invention, the pilot is able to train with the aircraft being presented with static and aerodynamic loads equivalent to those presented by live missiles. The inert form factored missile bodies 32 are additionally beneficial in that ground load crews can also be trained. In this regard, the ground load crews can run BIT testing on the ground, and they can also attach the form factored inert missile body 32 to the aircraft.

The foregoing discussion describes merely exemplary embodiments of the present invention. One skilled in the art will readily recognize from such discussion, and from the accompanying drawings and claims, that various changes, modifications and variations can be made therein without departing from the spirit and scope of the invention as defined in the following claims.

What is claimed is:

1. A missile simulator apparatus for use with an aircraft having a fire control system adapted to generate a plurality of control signals and at least one missile station including a missile interface, the apparatus comprising:

a housing releasably attached to the aircraft;

receiving means for receiving said plurality of control signals from the aircraft fire control system, said receiving means disposed within said housing;

simulation means for selectively simulating a plurality of missile interface response signals, said simulation means being disposed within said housing and being operative to generate a response to said plurality of control signals received from said aircraft fire control system; and electronic communication means for providing an umbilical interface between said simulation means and said aircraft fire control system;

whereby the apparatus is operative for testing the missile interface.

2. The missile simulator apparatus of claim 1 wherein said missile interface response signals include weapons identification, built-in-test, and launch cycle responses.

3. The missile simulator apparatus of claim 2 wherein said launch cycle responses include the opening of missile interlock.

4. The missile simulator apparatus of claim 1 wherein said housing is disposed within an aircraft missile station.

5. The missile simulator apparatus of claim 1 further comprising an inert missile body adapted to be mounted to an aircraft missile station, said missile body having substantially equivalent physical dimensions and creating substantially equivalent static and aerodynamic load characteristics as an equivalent conventional missile; and wherein said housing is disposed within said missile body.

6. The missile simulator apparatus of claim 5 wherein said missile being simulated is an advanced, medium range, air-to-air missile.

7. The missile simulator apparatus of claim 5 further comprising:

second electronic communications means for providing a data link interface between said simulation means and said aircraft fire control system; and data link and data capture means for processing and recording data communications between said simulation means and said aircraft fire control system;

whereby said data communications are subsequently accessible for post-flight analysis.

8. The missile simulator apparatus of claim 7 wherein said second electronic communications means comprises radio frequency detection means.

9. The missile simulator apparatus of claim 8 wherein said radio frequency detection means includes antenna means.

10. A missile simulator apparatus for an aircraft of the type having a fire control system adapted to generate a plurality of control signals and at least one missile station having a missile interface, said apparatus comprising:

a portable training module for substantially simulating a plurality of missile interface response signals of a missile, said training module including a housing and being operative to generate a response to said plurality of control signals received from said fire control system, said plurality of missile interface response signals including a missile release signal adapter for simulating release of said missile;

receiving means for receiving said plurality of control signals from the aircraft fire control system, said receiving means disposed within said housing;

simulation weans for selectively simulating a plurality of missile interface response signals, said simulation means disposed within said housing;

a communications port disposed on said training module; and an umbilical interface adapted to attach to said port and provide a data communication channel between said training module and said fire control system;

whereby said fire control system and said training module interchange information by coded signals for testing of said missile interface.

11. The apparatus of claim 10 wherein said training module comprises a microcomputer including a memory.

12. The apparatus of claim 11 wherein said training module further comprises means for conditioning signals received from said aircraft.

13. The apparatus of claim 12 wherein said training module further comprises a military standard 1553 interface chip set for transmitting and receiving coded signals.

14. The apparatus of claim 13 wherein said training module further comprises power conversion circuitry for converting a single source of power received from said aircraft into a plurality of different voltages.

15. The apparatus of claim 10 further comprising an inert missile body adapted to be mounted to an aircraft missile station, said missile body having substantially equivalent physical dimensions and creating substantially equivalent static and aerodynamic load characteristics as an equivalent conventional missile; and wherein said portable training module is disposed within said missile body.

16. A missile simulator apparatus for an aircraft having a fire control system adapted to generate a plurality of control signals including discrete signals and at least one missile station having a missile interface, the apparatus comprising:

a portable training module operative to generate a response to data communications received from said fire control system and including:

(i) a housing;

(ii) receiving means disposed in said housing for receiving said plurality of control signals from the aircraft fire control system;

(iii) a microprocessor disposed in said housing;

iv) discrete signal conditioning means for filtering said discrete signals received from said fire control system; and v) simulation means for substantially simulating a plurality of missile interface response functions of a missile in response to said plurality of control signals, said plurality of missile interface functions including a missile release function;

an umbilical interface for providing a data communication channel between said apparatus and said fire control system prior to a simulated launch of said missile;

an inert missile body adapted to be mounted to an aircraft missile station, said missile body having substantially equivalent physical dimensions and creating substantially equivalent static and aerodynamic load characteristics as an equivalent conventional missile, said portable training module being disposed within said missile body;

a data link interface for providing a data communication channel between said apparatus and said fire control system subsequent to a simulated launch of said missile; and a data link and data capture module for processing and recording data communications between said fire control system and said apparatus;

whereby said fire control system and said training module interchange information by coded signals for testing of said missile interface.

* * * * *